US006357323B2

(12) United States Patent
Chi et al.

(10) Patent No.: US 6,357,323 B2
(45) Date of Patent: Mar. 19, 2002

(54) WRENCH

(76) Inventors: Yuan-Ching Chi, No. 16-5, Chung Nan Lane, Kuang Hsing Road, Taiping City, Taichung; Shyong-Chuan Chen, No. 89-1, Lane 121, Tu Chen Rd., Ta Li Hsiang, Taichung Hsien, both of (TW)

( * ) Notice: Subject to any disclaimer, the term of this patent is extended or adjusted under 35 U.S.C. 154(b) by 0 days.

(21) Appl. No.: 09/777,125

(22) Filed: Feb. 5, 2001

Related U.S. Application Data

(63) Continuation-in-part of application No. 09/192,365, filed on Nov. 16, 1998, now abandoned.

(51) Int. Cl.[7] ..... B25B 13/46
(52) U.S. Cl. ..... 81/60; 81/63.1
(58) Field of Search ..... 81/60, 63.1, 63.2

(56) References Cited

U.S. PATENT DOCUMENTS 5,404,773 A * 4/1995 Norville ..... 81/63.1
5,495,783 A * 3/1996 Slusar et al. ..... 81/63.2
5,520,073 A * 5/1996 Bakula et al. ..... 81/63.1
5,979,274 A * 11/1999 Hsieh ..... 81/60
6,263,765 B1 * 7/2001 McCamley ..... 81/60 X

* cited by examiner

*Primary Examiner*—James G. Smith
(74) *Attorney, Agent, or Firm*—Charles E. Baxley

(57) ABSTRACT

A wrench includes a handle having a ring-shaped head in which a toothed member is rotatably received. Three protrusions extend radially inward from an inner periphery of the ring-shaped head so as to define three recesses between the protrusions. Two grooves are respectively defined in a top and a bottom of each of the protrusions so as to two elastic members therein. A top cap and a lower cap are respectively mounted to the ring-shaped head. The lower cap has three curved slots defined in a top surface thereof. Three pawl members engaged with the toothed member are movably located in the recesses and each have a pin movably received in the curved slots of the lower cap. The elastic members bias a rear surface of each of the pawl members.

4 Claims, 7 Drawing Sheets

WRENCH

FIELD OF THE INVENTION

This application is a Continuation-In-part application for U.S. patent application Ser. No. 09/192,365 to Chi et al., filed on Nov. 16, 1998 with a title of "Wrench" now abdn.

BACKGROUND OF THE INVENTION

Conventional wrenches generally can rotate a bolt or a nut only in one direction. Therefore, when using the wrenches, the users have to mount the nut or the head portion of the bolt by the box end of the wrench and rotate the wrench in one direction to tighten the nut or the bolt. When loosening the nut or the bolt, the users have to turn the wrench and re-mount the nut or the bolt and rotate the nut or the bolt in the opposite direction. Such actions take too much time and have a low efficiency. Although ratchet tools are allowed to be rotated without disengaging form the nut or the bolt, the ratchet tools involve too many parts and need a larger and thick head to receive the parts therein so that the ratchet tools are not suitable used in a narrow space.

SUMMARY OF THE INVENTION

The present invention relates to a wrench and comprises a handle having a ring-shaped head in which a toothed member is received. At least one protrusion extends radially inward from an inner periphery of the ring-shaped head so as to define at least one recess between two ends of the at least one protrusion. Two grooves are respectively defined in a top and a bottom of the at least one protrusion so as to receive two elastic members therein. A top cap and a lower cap are respectively mounted to the ring-shaped head, and the lower cap has at least one curved slot defined in a top surface thereof A toothed member is rotatably received in the ring-shaped head and located between the top cap and the lower cap. At least one pawl member is movably located in the at least one recess and engaged with the toothed member. The two elastic members bias a rear surface of the at least one pawl member in the at least one recess. A pin extends from a bottom of the at least one pawl member and is movably received in the at least one curved slot. The at least one curved slot is wider than a diameter of the pin of the at least one pawl member.

The object of the present invention is to provide a wrench which has a thin ring-shaped head and can be rotated in two opposite directions without removing the wrench from the object to be tightened or loosened.

These and further objects, features and advantages of the present invention will become more obvious from the following description when taken in connection with the accompanying drawings which show, for purposes of illustration only, several embodiments in accordance with the present invention

DETAILED DESCRIPTION OF THE PREFERRED EMBODIMENTS

Figure 1:
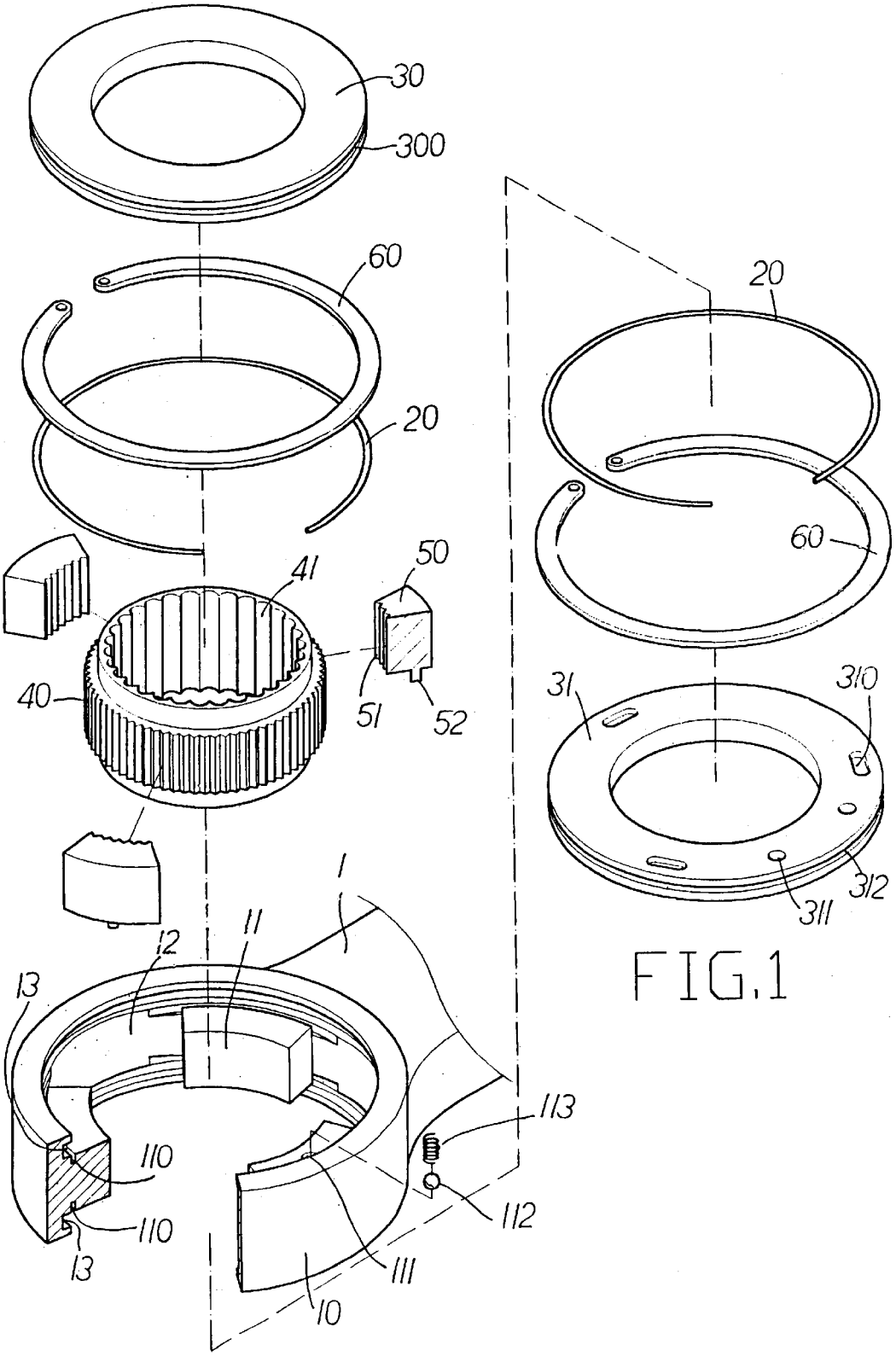
FIG. 1 is an exploded view of the wrench of the present invention.
Figure 2:
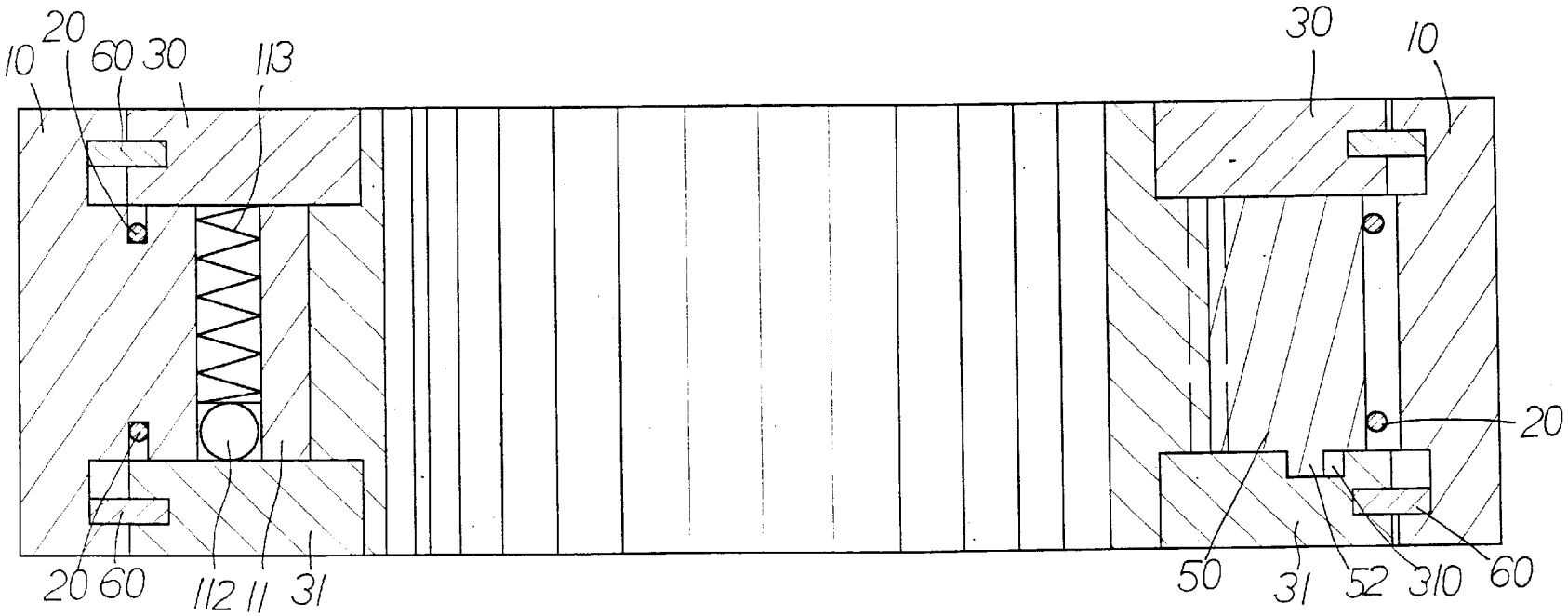
FIG. 2 is an end cross sectional view to show the pawl members biased by elastic members.
Figure 3:
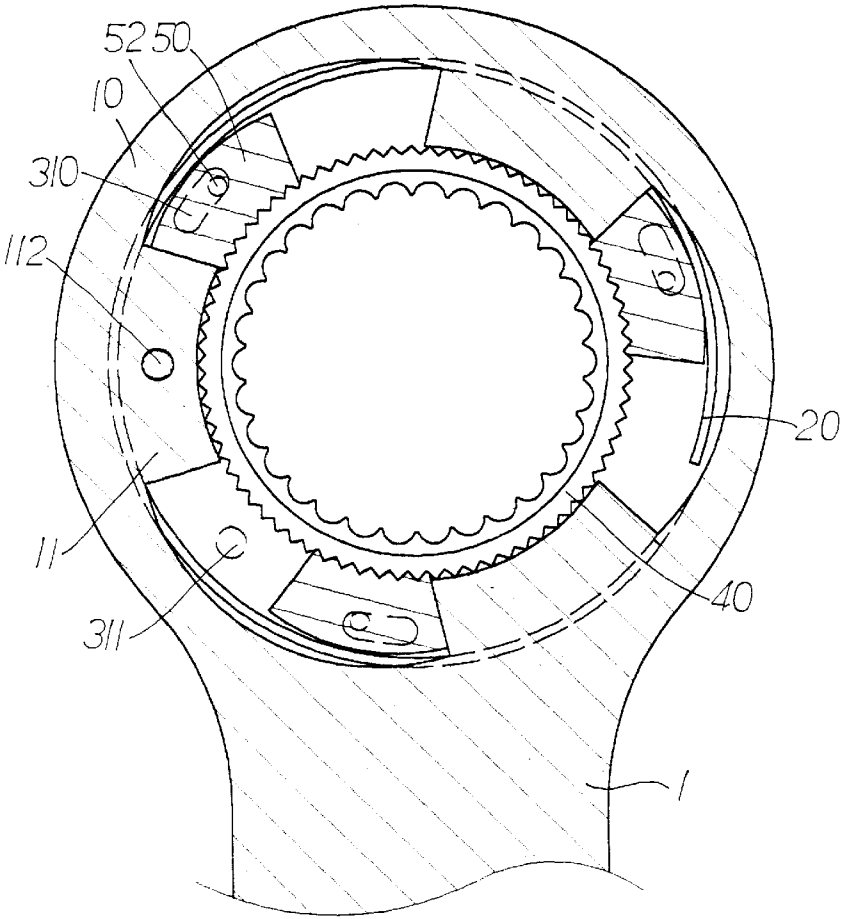
FIG. 3 is a top cross sectional view to show the position of the pawl members when the wrench is rotated counter clockwise.

Referring to FIGS. 1 to 3, the wrench of the present invention comprises a handle 1 having a ring-shaped head 10 in which a ring-shaped toothed member 40 is received. Three protrusions 11 extend radially inward from an inner periphery of the ring-shaped head 10 so as to define three recesses 12 between the protrusions 11. Two grooves 110 are respectively defined in a top and a bottom of the at least one protrusion 11 and two elastic members 20 are respectively received in the two grooves 10. The ring-shaped head 10 has two receiving grooves 13 defined in the inner periphery of the ring-shaped head 10 and a top cap 30 and a lower cap 31 are respectively mounted to a top side and a bottom side of the ring-shaped head 10. Each of the top cap 30 and the lower cap 31 has an engaging groove 300/312 defined in an outer periphery thereof. Two C-shaped clamps 60 are respectively received in the two receiving grooves 13 and engaged with the engaging grooves 300, 312 in the top cap 30 and the lower cap 31 to position the two caps 30, 31. The lower cap 31 has three curved slots 310 and two concavities 311 respectively defined in a top surface thereof.

The ring-shaped toothed member 40 is located between the top cap 30 and the lower cap 31, and has points 41 defined in an inner periphery thereof so as to engage with an object such as a hexagonal head of a bolt. Three pawl members 50 are movably located in the three recesses 12 respectively and each pawl member 50 has teeth 51 defined in a front surface thereof so as to be engaged with the toothed member 40. The two elastic members 20 bias a rear surface of the pawl members 50 in the recesses 12. A pin 52 extends from a bottom of each of the three pawl members 50 and is movably received in the curved slot 310 in the lower cap 31, Each of the curved slots 310 is wider than a diameter of the pin 52 of the pawl member 50 so that the pawl member 50 is allowed to moved radially between the toothed member 40 and the inner periphery of the ring-shaped head 10 of the wrench.

Figure 4:
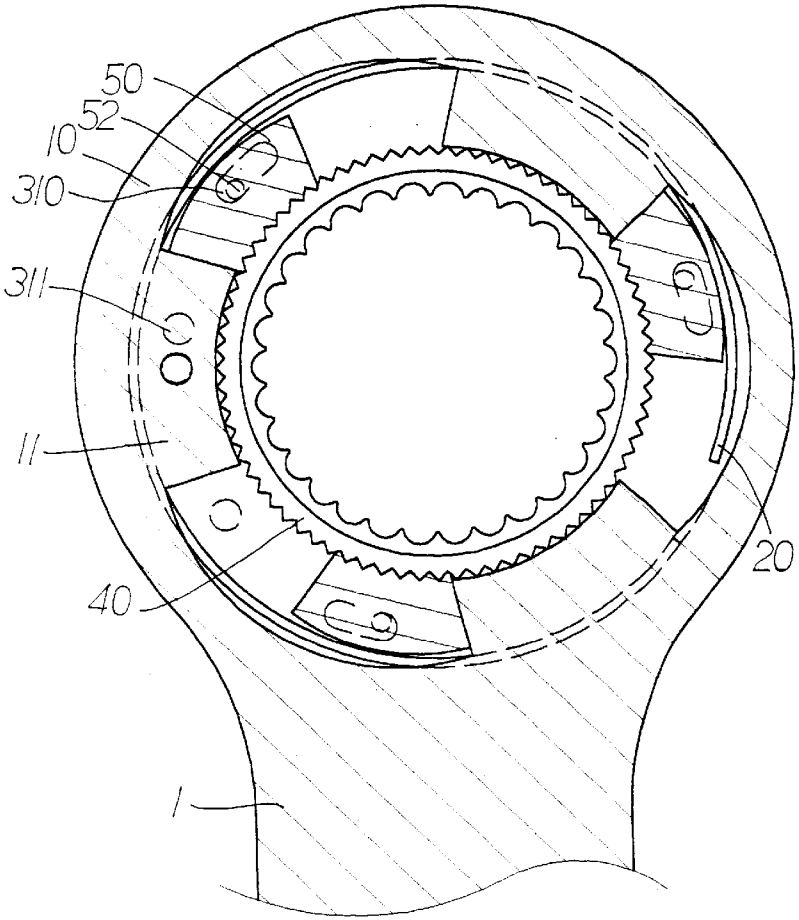
FIG. 4 is a top cross sectional view to show that the handle of the wrench is about to rotate clockwise.

One of the three protrusions 11 has a passage 111 defined therethrough, and a ball 112 and a spring 113 are respectively received in the passage 111. The ball 112 is received in one of the concavities 311 by rotating the ring-shaped head 10 relative to the lower cap 31. FIG. 3 shows that the wrench is rotated counter clockwise and the pins 52 are located in an end of the curved slots 310 so that when rotating the wrench, the pawl members 50 are moved counter clockwise. FIG. 4 shows that the wrench is about to rotate clockwise and the ring shaped toothed member 40 will not rotate. In FIG. 3, the ball 112 is received in one of the concavities 311 and the pin 52 of each pawl member 50 contacts an inner end of the curved slot 310 so that the pawl members 50 are moved with the rotation of the wrench.

Figure 6:
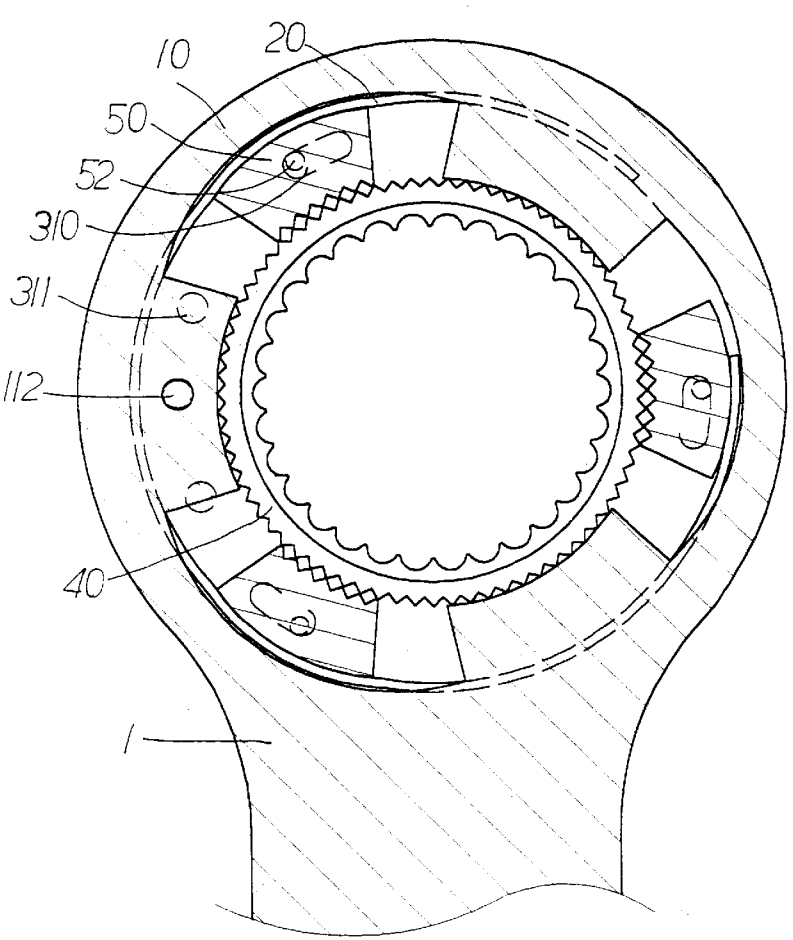
FIGS. 5 and 6 are a top cross sectional view to show the pawl members are moved between the protrusions.
Figure 5:
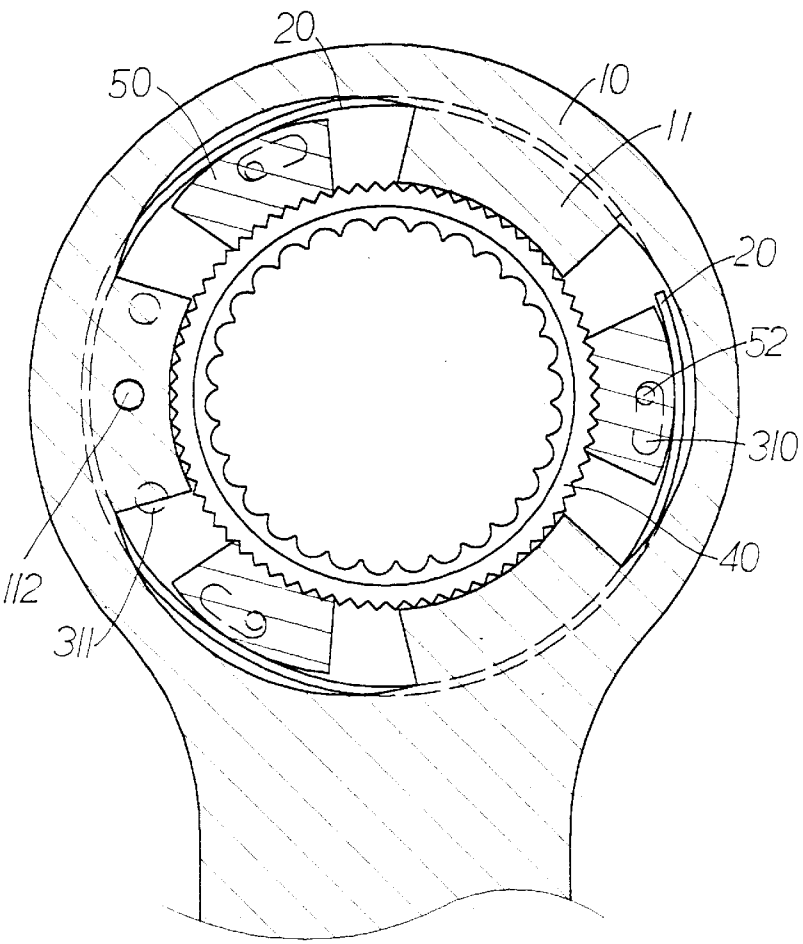
Figure 8:
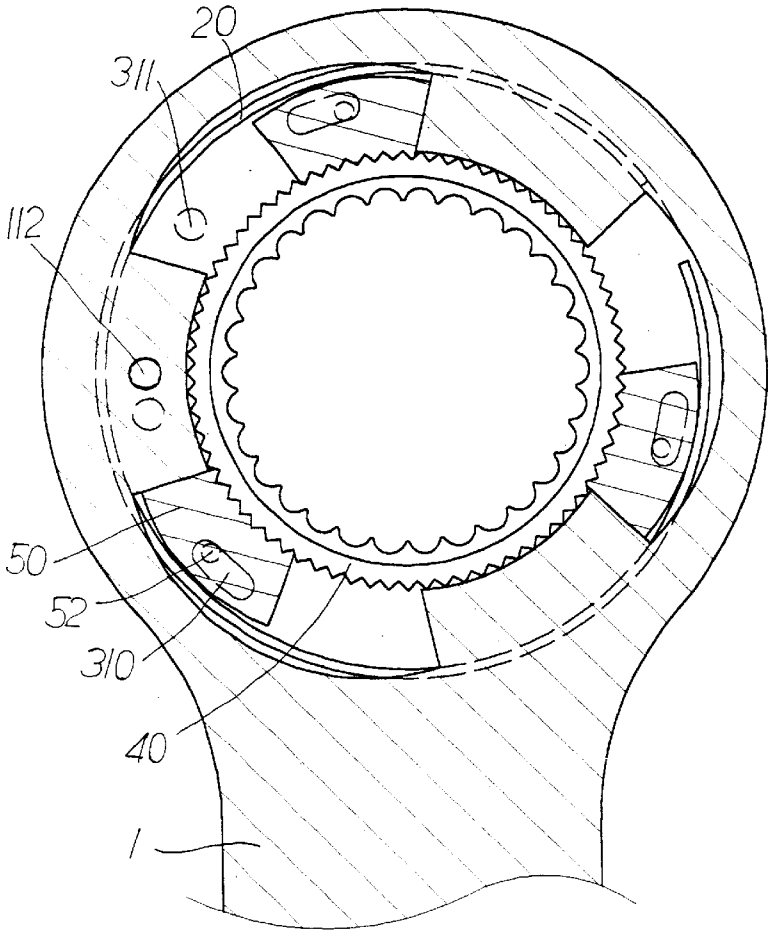
FIG. 8 is a top cross sectional view to show that the handle of the wrench is about to rotate counter clockwise.
Figure 7:
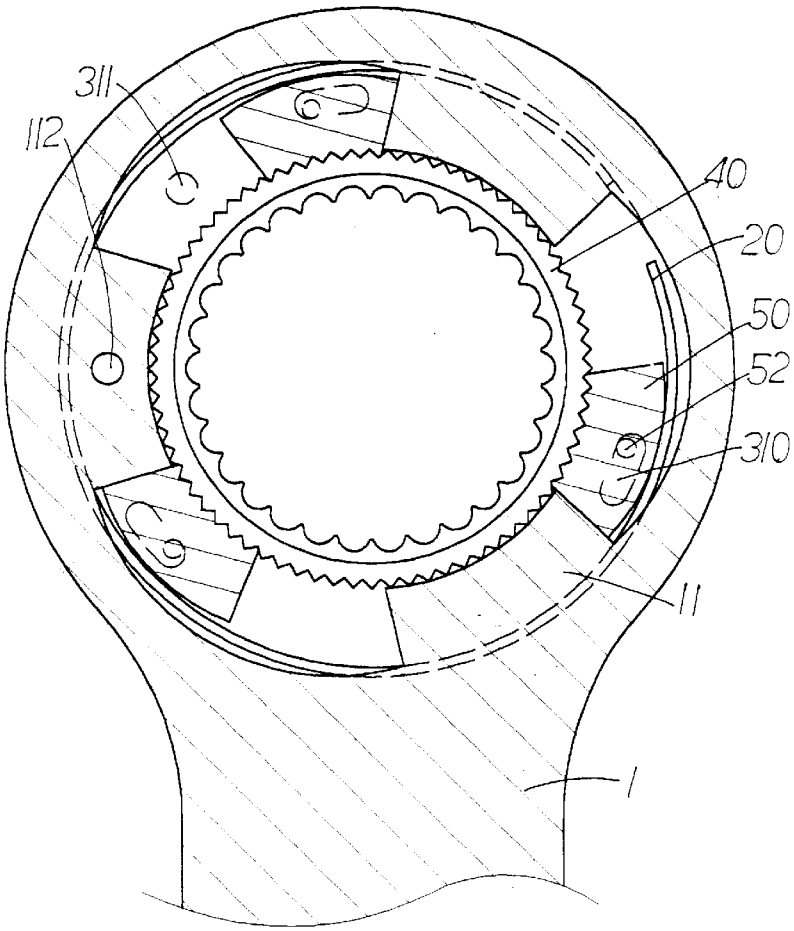
FIG. 7 is a top cross sectional view to show the position of the pawl members when the wrench is rotated clockwise.

When the wrench is rotated clockwise, as shown in FIGS. 5 and 6, the protrusions 11 move away from the pawl members 50 and the pawl members 50 are not moved with the rotation of the wrench and pushed by the toothed member 40. The pawl members 50 then push the elastic members 20 and move over the toothed member 40 without rotating the toothed member 40. FIGS. 7 and 8 show that the pins 52 of the pawl members 50 are moved to the other inner end of the curved slots 310 so that when rotating the wrench clockwise, the pawl members 50 moved with the wrench to rotate the ring-shaped toothed member 40.

The three pawl members 50 provide a large enough contact area between the pawl members 50 and the toothed member 40 so as to produce a large torque.

Figure 9:
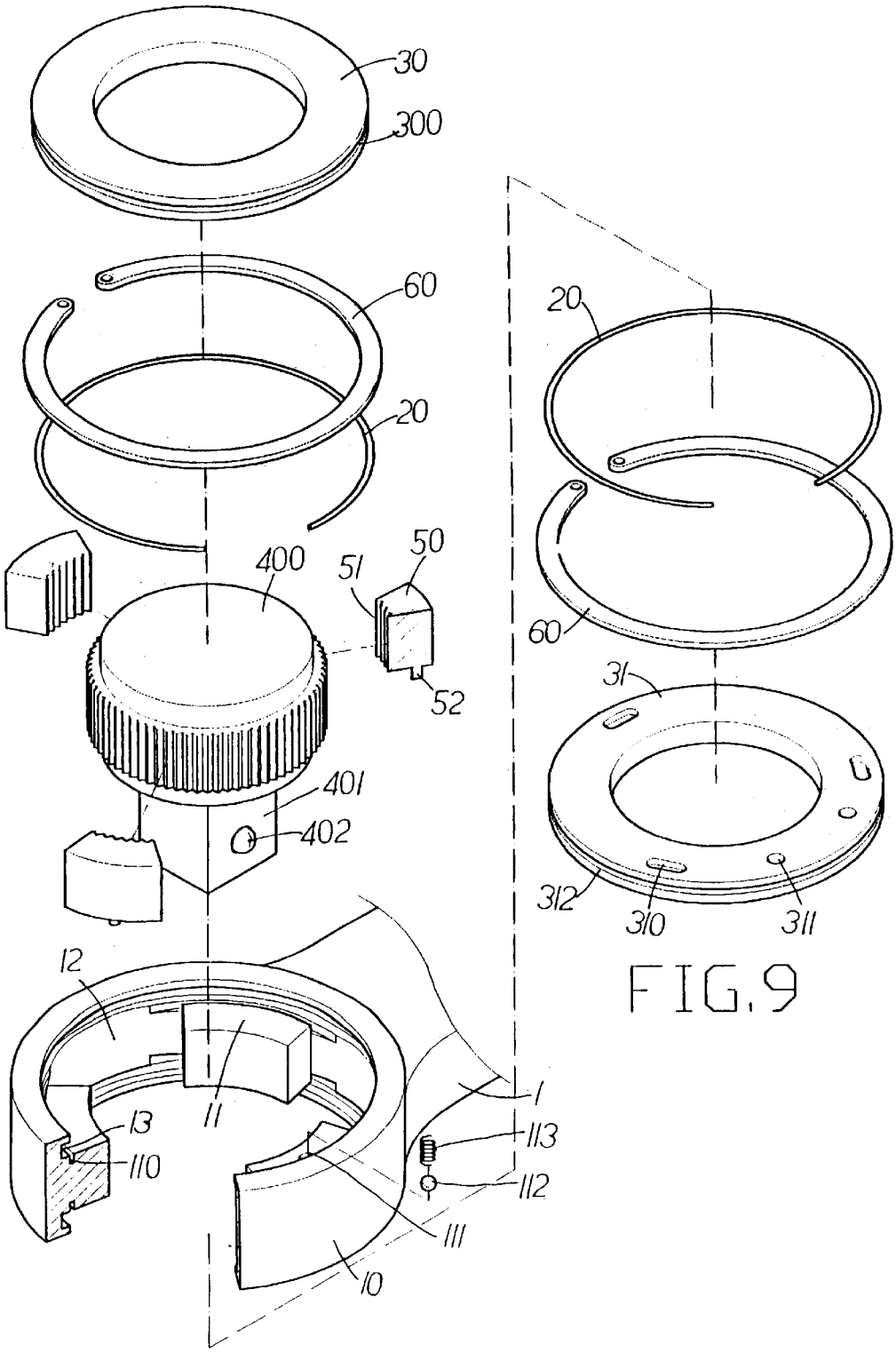
FIG. 9 is an exploded view to show another embodiment of the toothed member of the wrench of the present invention.
Figure 10:
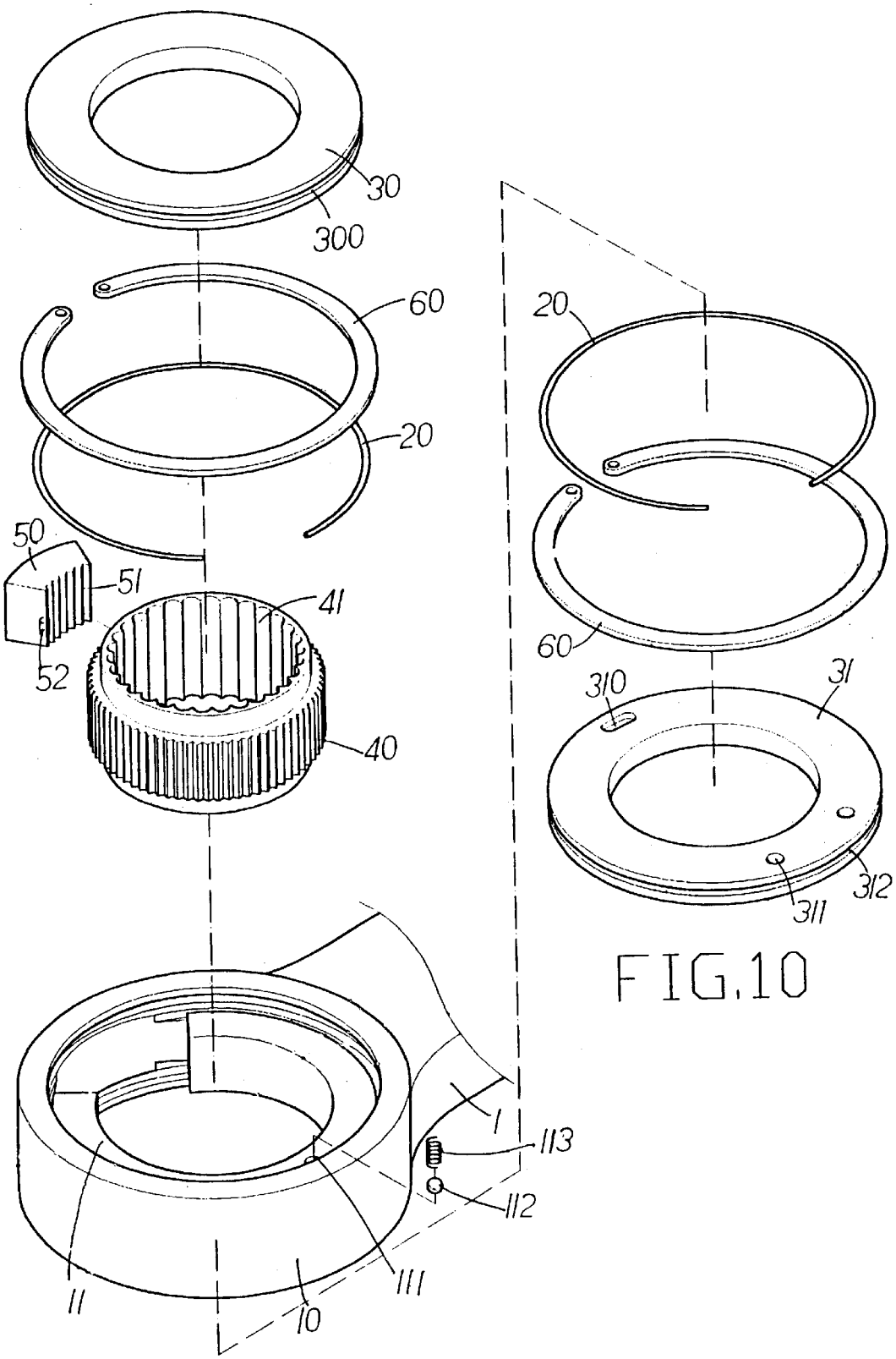
FIG. 10 is an exploded view to show yet another embodiment of the wrench of the present invention.

FIG. 9 shows that the toothed member can be a toothed member 400 with a shank 401 extending therefrom and a ball 402 is embedded in the shank 401 so that a socket can be mounted to the shank 401 FIG. 10 shows that only one pawl member 50 and only one protrusion 11 are employed and performs a similar function as that in FIG. 1.

Although the invention has been explained in relation to its preferred embodiment, it will be understood by those skilled in the art that various changes in form and detail may made without departing from the scope and spirit of the present invention.

What is claimed is:

1. A wrench comprising:

a handle having a ring-shaped head, at least one protrusion extending radially inward from an inner periphery of said ring-shaped head so as to define at least one recess between two ends of said at least one protrusion, two grooves respectively defined in a top and a bottom of said at least one protrusion and two elastic members respectively received in said two grooves;

a top cap and a lower cap respectively mounted to said ring-shaped head, said lower cap having at least one curved slot defined in a top surface thereof;

a toothed member rotatably received in said ring-shaped head and located between said top cap and said lower cap, and at least one pawl member movably located in said at least one recess and having teeth defined in a front surface thereof so as to be engaged with said toothed member, said two elastic members biased a rear surface of said at least one pawl member in said at least one recess, a pin extending from a bottom of said at least one pawl member and movably received in said at least one curved slot in said lower cap, said at least one curved slot being wider than a diameter of said pin of said at least one pawl member.

2. The wrench as claimed in claim 1, wherein said lower cap has two concavities defined in said upper surface thereof and said at least one protrusion has a passage defined therethrough, a ball and a spring respectively received in said passage, said ball received in one of said concavities by rotating said ring-shaped head relative to said lower cap.

3. The wrench as claimed in claim 1, wherein said toothed member is a ring-shaped member and has points defined in an inner periphery thereof.

4. The wrench as claimed in claim 1, wherein said ring-shaped head has two receiving grooves defined in said inner periphery of said ring-shaped head, said top cap and said lower cap each having an engaging groove defined in an outer periphery thereof, two C-shaped clamps respectively received in said two receiving grooves and engaged with said engaging grooves in said top cap and said lower cap.

* * * * *